United States Patent [19]

Nashan et al.

[11] 4,211,533

[45] Jul. 8, 1980

[54] METHOD OF HOT-BRIQUETTING MIXTURES OF COAL AND COKE

[75] Inventors: Gerd Nashan, Oberhausen; Josef Langhoff, Dinslaken; Joachim Lehmann, Essen-Haarzopf; Kurt Kleisa, Hattingen; Dieter Makrutzki, Essen, all of Fed. Rep. of Germany

[73] Assignees: Bergwerksverband GmbH; Ruhrkohle AG, both of Essen, Fed. Rep. of Germany

[21] Appl. No.: 894,846

[22] Filed: Apr. 10, 1978

[30] Foreign Application Priority Data

Apr. 9, 1977 [DE] Fed. Rep. of Germany ..... 2715977

[51] Int. Cl.[2] ..... C10L 5/00

[52] U.S. Cl. ..... 44/10 C; 44/10 H

[58] Field of Search ..... 44/10 C, 10 H, 10 G

[56] References Cited

U.S. PATENT DOCUMENTS

| | | | |
|---|---|---|---|
| 3,841,849 | 10/1974 | Beckman | 44/10 H |
| 3,926,576 | 12/1975 | Schmalfeld et al. | 44/10 H |
| 4,002,534 | 1/1977 | Rammler et al. | 44/10 C |

*Primary Examiner*—Carl F. Dees

*Attorney, Agent, or Firm*—Michael J. Striker

[57] ABSTRACT

Coke is mixed with bituminous coal and the mixture is converted into briquettes. To obtain high-quality and high-strength briquettes, the temperature of the coke is adjusted, prior to mixing, to such a level that when the mixing takes place, the coke/coal mixture will have a precisely predetermined temperature within the scope of 400°–500° C. The exact temperature within this range is selected in dependence upon the characteristics of the coke and the coal.

7 Claims, 1 Drawing Figure

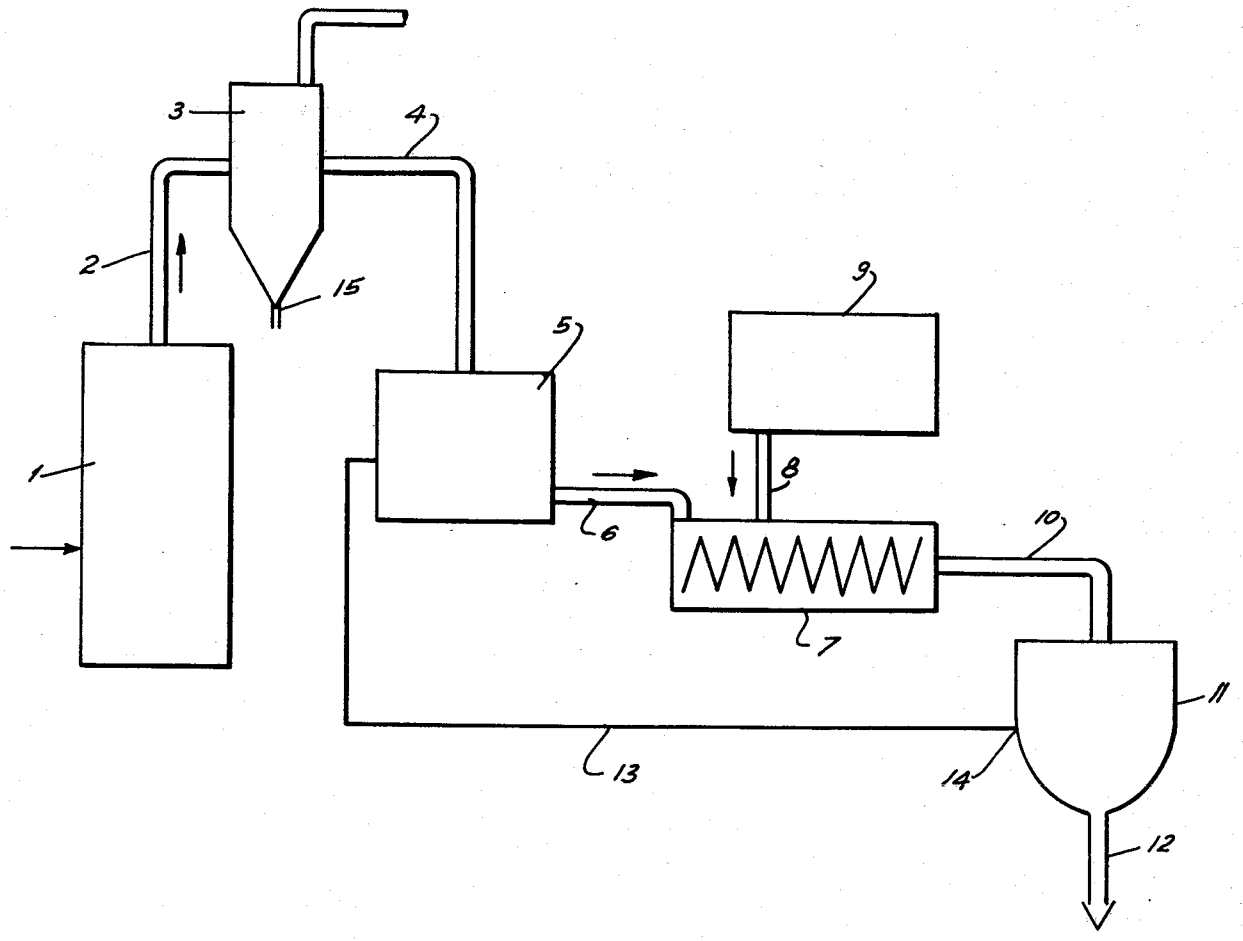
1
2
3
4
5
6
7
8
9
10
11
12
13
14
15

METHOD OF HOT-BRIQUETTING MIXTURES OF COAL AND COKE

BACKGROUND OF THE INVENTION

1. Field of the Invention

The present invention relates to the briquetting of mixtures of coal and coke.

More particularly, the invention relates to the hot-briquetting of such coal/coke mixtures.

2. The Prior Art

It is known from the prior art to convert coal into coke—e.g., in a fluidized-bed reactor or in a stream of hot gas—to obtain hot briquetting coke which is then mixed with coking (i.e., bituminous) coal whereupon the resulting mixture is briquetted at a temperature of about 400°-500° C.

The amount of coking coal which is added to form the mixture varies between 20 and 40% by weight of the mixture, depending upon the characteristics of the coal. The weight percentage must be the higher, the lower the bitumen content of the coal in order to obtain briquetts of adequate strength (i.e., resistance to crumbling, breaking and abrasion).

In the prior art the coal will have a temperature within the range of 10°-100° C. prior to mixing with the coke which itself will have a temperature of between about 700°-800° C. The coal temperature depends upon the source from which the coal is fed; a 100° C. temperature will obtain if the coal is added to the coke immediately after undergoing a drying operation. Because of the temperatures of the coal and coke relative to one another, the temperature of 400°-500° C. desired for the coal/coke mixture can be readily attained as a result of the mixing.

However, difficulties have been experienced in obtaining briquettes of uniform quality, especially uniform strength, with the prior-art approach. Upon long and detailed investigation of the problem it was found that contrary to previous belief the quality and strength of the briquettes are dependent not merely upon the weight percentage of coal in the briquetting mixture (making allowance for the characteristics of the particular coal). The quality and strength of the briquettes are, surprisingly, also influenced—and at least equally so—by another factor, namely the briquetting temperature which must be individually accommodated (upon empirical determination) to the characteristics of the coal and the coke in a particular mixture. It has been found to be of central importance that the temperature of the mixture being briquetted not only be prevented as much as possible from fluctuating, but that it be adjusted to within substantially ±5° C. to an individual briquetting temperature. Contrary to previously held beliefs it is not possible to obtain briquettes of consistently maximum quality and strength by adjusting the temperature to within e.g., ±20° C. in the 400°-500° C. range.

SUMMARY OF THE INVENTION

Accordingly, it is an object of the present invention to overcome the disadvantages of the prior art.

More particularly, it is an object of the invention to provide an improved briquetting method of the type under discussion, which avoids the aforementioned disadvantages and permits the manufacture of briquettes of consistently high quality and strength.

In keeping with these objects, and with others which will become apparent hereafter, one feature of the invention resides, briefly stated, in a method of making briquettes in which coke and coking coal are admixed to form a briquetting mixture having a temperature in the range between about 400°-500° C., the improvement wherein the coke temperature is adjusted, prior to mixing of the coke with the coking coal, to a temperature level which will, upon mixing of the coke with the coking coal, result in the mixture having a selected briquetting temperature in the range between about 400° and 500° C.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE is a diagrammatic illustration of an installation for carrying out the novel method.

DESCRIPTION OF THE PREFERRED EMBODIMENTS

The FIGURE illustrates an installation which is suitable for carrying out the inventive method. The individual elements of the installation are known per se and, therefore, require no detailed description.

Coking coal is admitted into a reactor 1, as indicated by the arrow, wherein it is heated to be thereupon transferred via conduits 2, 4 into a thermal conditioning vessel 5. As shown, a cyclone 3 may be interposed between the reactor 1 and the vessel 5, for withdrawal of gases and discharge of other substances at 15.

In the vessel 5 the heated coking coal slides from the top to the bottom of the vessel in form of a coal layer and becomes cooled due to contact with appropriate heat-exchange surfaces (e.g., baffles through which cooling liquid, such as water, circulates. The cooled coking coal is then transferred via conduit 6 into a mixer 7 (e.g., a screw-type mixer) which also receives coking (bituminous) coal via a conduit 8 from a reservoir 9. The coking coal and the baking coal undergo intensive mixing in the mixer 7 and the mixture then forwarded to an agitating vessel 11 (e.g., equipped with stirrers) from where it passes via outlet 12 into the not-illustrated briquetting press. A conductor 13 connects the vessel 5 with a temperature sensor 14 of the vessel 11 so that the degree of cooling to which the coking coal is subjected in the vessel 5 can be automatically regulated in dependence upon the mixture temperature detected by the sensor 14 which may extend into contact with the mixture in vessel 11. This automatic regulation via the just-described simple—and optional—feed-back circuit may be especially desirable if for manufacturing reasons, or to reduce the strain on the cooling equipment, it is desired to change from hot dry coking coal (reservoir 9) to a partially moist coking coal or to a non-dried coking coal.

The invention will now be further described on hand of several illustrative examples.

EXAMPLE 1

A semibituminous coal having 16% by weight of volatile contents and a particle size smaller than 10 mm was admitted into the reactor 1 and heated to 750° C. It was thereupon transferred to the vessel 5 wherein it was cooled to 640° C. with a concomitant development of 0.7 t/h of saturated steam (from heating of the cooling fluid which was water) at a pressure of 10 bar. Upon being cooled to 640° C. the coke was transferred via conduit 6 to mixer 7 into which baking coal was at the same time admitted from reservoir 9 via conduit 8. The mixture of coke and coal was transferred from mixer 7 via conduit 10 to the agitating vessel 11, and from there via conduit 12 to a briquetting press.

The reactor 1 received 10 t/h of the semibituminous coal; of this amount, 2 t were distilled off as gas, tar and oil—$H_2O$. The residual 8 t/h of coal, now converted into coke, were mixed in mixer 7 with 2 t/h of baking coal having a particle size smaller than 1 mm and a volatile content of 25–28% by weight, which was admitted from reservoir 9 at a temperature of 110° C. Therefore, the mixing ratio of coke to baking coal was 75:25; the mixing and subsequently the briquetting temperature was about 460° C.

The (not illustrated) briquetting press converted the mixture into 9.5 t/h of hot briquettes which were cooled to ambient temperature in a shaft furnace. Tests conducted on the thus obtained briquettes showed them to have a mechanical (breaking) strength of 3000 N and an abrasion loss ($M_{10}$) of 5% by weight, measured according to German Industrial Norm (DIN) 51717.

EXAMPLE 2

Flame coal having a particle size smaller than 8 mm and containing 42% by weight of volatiles, was admitted in quantities of 15 t/h into reactor 1, and heated to 600° C. in order to obtain a maximum yield of tar. This produced 2.8 t/h of tar and oil, in addition to gas, water and coke. The coke, amounting to 9.5 t/h, was heated to 830° C. by admitting it into the top of the reactor vessel 5 for gravity-descent to the bottom of the same, while at the same time a quantity of 1000 $m^3$/h of air was passed through the reactor vessel 5 in counterflow to the coal. This resulted in partial oxydation of the coke which raised its temperature to 830° C.

The thus heated 9.5 t/h of coke were mixed in the mixer 7 with 6.3 t/h of baking coal at 105° C. and having a particle size smaller than 1 mm and a volatile content of between 24–28% by weight. The mixing ratio of coke to coal was 60:40%, the mixing and briquetting temperature was about 470° C.

The mixture was converted into 14 t/h of hot briquettes having a mechanical strength of 3500 N and an abrasion loss of 7% by weight ($M_{10}$) measured according to DIN 51717.

EXAMPLE 3

Semibituminous coal having a particle size smaller than 10 mm and a volatile content of 16% by weight, was admitted into reactor 1 in a quantity of 10 t/h. It was heated to 780° C., resulting in distilling-off of 2 t/h of gas, tar and oil-$H_2O$. The remaining 8 t/h of coke were transferred into vessel 5 to rum from the top to the bottom of the same by gravity descent. Coking water was sprayed into the vessel 5 in an amount of 0.75 $m^3$/h to cool the coke to 640° C.; a desirable incidental result was the thermal decomposition of ecologically undesirable components in the water during conversion of the water into steam.

The remaining 8 t/h of cooled coke were then transferred to the mixer 7 into which baking coal at 110° C. was admitted from reservoir 9. The baking coal had a particle size smaller than 1 mm and between 75–25% by weight of volatiles. It was admitted in a quantity of 2 t/h so that the mixing ratio of coke to coal was 75:25; the mixing and briquetting temperature was about 460° C.

The mixture was converted in the briquetting press into 9.5 t/h of hot briquettes which were cooled to ambient temperature in a shaft furnace. The mechanical strength of the briquettes was found to be 3000 N and their abrasion loss ($M_{10}$), tested according to DIN 51717, was 5% by weight.

It will be appreciated from the foregoing that the thermal conditioning of the coke in the vessel 5 can be carried out in various different ways.

The vessel may be provided with conduits which extend into the coke to contact it and through which a heat-exchange fluid is circulated. This offers indirect cooling of the coke the efficiency of which may be further improved by agitating the coke via an inert gas that is blown into the vessel. If the heat-exchange fluid is water, the heat removed from the coke can be recovered since steam will be produced which is available for other useful purposes.

The vessel 5 may also be of the type through which the coke passes in free fall. In that event, coking water may be sprayed onto the coke to cool it and deleterious substances dissolved in the water are thermally decomposed and rendered harmless without posing any ecological problems.

The vessel 5 may, however, also be of the type through which the coke flows under the influence of gravity to be agitated and directed by built-in baffles. This will be the case when the coke must be heated, rather than cooled. A precisely controlled quantity of air is admitted in counterflow into the vessel so that combustion heat is obtained due to partial oxydation of the coke.

Of course, a fluidized-bed reactor or a travelling bed (layer) reactor can also be employed as the vessel 5.

The invention assures in all instances that the briquette quality is made independent of the temperature fluctuation of the hot coke, as well as of the baking coal. Thus, the temperature found to be most advantageous for producing from a specific ratio of coke and coal, wherein the coke and coal of the given mixture have specific characteristics, can be precisely controlled to obtain briquettes of maximum quality, including maximum strength.

In addition, the invention has still further advantages.

Coking of coal results in the liberation of a series of by-products. Tar and gas are the most valuable of these. It may be desirable—to obtain high-quality tar—to coke in such a manner that the final coke issuing from the reactor will have a relatively high temperature. If so, this can be readily achieved without thereby disadvantageously influencing the quality of briquettes made from a mixture of this coke with coking coal. For example, should it be necessary to obtain a final coke temperature of between about 700°–900° C. so as to produce—during the coking—a high-temperature tar having a desired quality, the resulting coke—which is too hot to yield a satisfactory briquetting mixture—can be readily cooled to lower temperature which has been found to be the most advantageous in terms of obtaining high-quality briquettes.

Again, to obtain from bituminous coal a maximum yield of liquid by-products (e.g., tar, oil) during coking, it is necessary to effect coking at temperatures of about 600° C. This will, however, then yield a coke which is too cool for subsequent mixing and hot-briquetting. This, also, can be corrected by resorting to the present invention, in that the coke temperature can be raised, instead of lowered, until a level is reached at which a mixture of this coke and the coking coal will produce high-quality briquettes.

Thus, the invention makes possible a much greater flexibility in the briquetting process than existed before. It enables the operator to select and maintain the optimum briquetting temperature without difficulty, even though the temperature of the coke and/or the quality (i.e., characteristics) of the coking coal may fluctuate during the briquetting operation, e.g., during a given production run.

While the invention has been illustrated and described as embodied in a method of hot-briquetting, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a method of making briquettes in which coke and coking coal are admixed to form a briquetting mixture having a temperature in the range between about 400°–500° C., the improvement wherein the coke temperature is adjusted, prior to mixing of the coke with the coking coal, to a temperature level which will, upon mixing of the coke with the coking coal, result in the mixture having a temperature within ±5% of a predetermined briquetting temperature lying within said range.

2. A method as defined in claim 1, wherein the coke is indirectly cooled by contact with heat-exchangers.

3. A method as defined in claim 1, wherein the coke is directly cooled.

4. A method as defined in claim 3, wherein the direct cooling is effected by contacting the coke with a heat-exchange fluid.

5. A method as defined in claim 3, wherein the direct cooling is effected by contacting the coke with coking water as a heat-exchange fluid.

6. A method as defined in claim 1; further comprising the step of sensing the temperature of the coke/coal mixture; and effecting the adjustment of the coke temperature as a function of the sensed temperature of the mixture.

7. A briquette made according to the method of claim 1.

* * * * *